US005437593A

United States Patent [19]

Gustavsen

[11] Patent Number: 5,437,593

[45] Date of Patent: Aug. 1, 1995

[54] ROLLER FOR PLANAR FLOORING

[76] Inventor: Willard Gustavsen, 12142 Range Rd., P.O. Box 37, Berrien Springs, Mich. 49103

[21] Appl. No.: 185,509

[22] Filed: Jan. 24, 1994

[51] Int. Cl.[6] ..... B05C 7/02

[52] U.S. Cl. ..... 492/13; 492/19; 15/230.11

[58] Field of Search ..... 492/13, 14, 19; 15/230.11

[56] References Cited

U.S. PATENT DOCUMENTS

| | | | |
|---|---|---|---|
| 563,044 | 6/1896 | Lewis | 492/13 |
| 1,464,512 | 8/1923 | Suhr | 492/13 |
| 2,813,292 | 11/1957 | McLendon | 15/230.11 |
| 3,205,526 | 9/1965 | Archibald | 15/230.11 |
| 3,263,260 | 8/1966 | Filler | 15/230.11 |
| 4,314,395 | 2/1982 | Brock | 15/230.11 |
| 4,335,483 | 6/1982 | Buck | 492/13 |
| 4,899,417 | 2/1990 | Schaffer et al. | 492/13 |
| 5,105,500 | 4/1992 | Bordogna | 492/13 |

FOREIGN PATENT DOCUMENTS

| | | | |
|---|---|---|---|
| 2232188 | 12/1974 | France | 15/230.11 |
| 191483 | 7/1936 | Switzerland | 492/13 |

*Primary Examiner*—Irene Cuda
*Attorney, Agent, or Firm*—Howard & Howard

[57] ABSTRACT

A roller assembly for rolling planar floorings has a pair of roller sections rotating about offset axes. A handle portion extends along an axis which is offset from the axes of both roller sections, and is positioned equal distance from the two axes. Thus, a force transmitted from the handle portion to the roller is equally divided between the two roller sections. The two offset roller sections prevent the handle from pivoting relative to the axis of the roller. Preferably, a pair of brackets mount the two roller sections and the handle. One of the roller sections is positioned between the brackets while the other roller section is defined by two roller portions extending axially outwardly from the brackets. In this way, a force for smoothing a seam on two adjacent planar flooring sections is concentrated in the central roller.

16 Claims, 1 Drawing Sheet

ROLLER FOR PLANAR FLOORING

BACKGROUND OF THE INVENTION

This application in general relates to an improved roller for use in rolling planar flooring.

In the prior art, seam rollers are utilized to flatten seams between two sections of adjacent planar flooring such as carpeting or linoleum. The prior art has typically utilized a single roller having a handle attached to the roller at the axial ends and about the rotational axis of the roller.

This particular type of prior art roller is somewhat inadequate in that the handle tends to pivot about the axis of the roller, thus misdirecting some of the force the user applies to the roller.

Another type of roller which been utilized is a dough roller such as is typically used in baking. A known dough roller has handles at each end of a roller section, with the handles being coaxial with the roller. A user applies force from the handles through the roller along the seam. While this type of prior art roller has proven beneficial in some applications, it would be desirable to improve the roller structure to more efficiently transfer force from the user to a roller moving along a seam.

In addition, in the prior art, handles have typically extended laterally or axially outwardly beyond the ends of the rollers. Thus, the handles have interfered with the use of the rollers to roll the end seams of a planar flooring section as may be found adjacent a wall.

If the prior art rollers, having handles extending outwardly, were used adjacent to a wall, it could mar or scuff the surface of the wall. This is, of course, undesirable.

SUMMARY OF THE INVENTION

In a broad aspect of this invention, a disclosed embodiment includes a roller section and a handle portion wherein the roller and handle portions are mounted on off-set axes.

In a preferred embodiment of this invention a roller for planar flooring includes a pair of spaced roller sections each rolling about an axis, and a handle offset from the axes of both roller sections. Preferably, the handle is positioned at a location intermediate to the axes of the rollers. Most preferably the handle axis is positioned at an equal distance from the axes of the two rollers such that a force transmitted from the handle to the two rollers is evenly divided between the two rollers.

The spaced roller sections, in combination with the handle section define a triangle which prevents the rollers from pivoting due to the force applied from the handle. Thus, should either of the roller sections begin to pivot due to the force applied from the handle, the other roller section would resist such pivoting. A user would apply a downward force which would be effectively split between the two roller sections. This would thus result in smooth operation of the roller, and efficient transfer of force.

In a most preferred embodiment of this invention, a first of the sets of rollers includes two rollers spaced along their axis by a gap. The second roller includes a single roller section at an axial location aligned with the gap. Thus, the first roller section has two outer roller sections with a central space. The second roller section has a single central roller section. Most preferably all three rollers in the two sections are of the same length and diameter such that they have equal surface areas.

The force in the single central roller of the first roller section will thus be double that in either of the two outer rollers in the first roller sections.

In a most preferred embodiment of this invention, the handle portions extend axially outwardly for a distance less than the axially outermost distance of the outer rollers. Thus, the outer rollers can be used to roll the outer edges of a planar flooring. In the prior art, handles may have extended beyond the roller sections, and the handles would interfere with the use of the prior art rollers to roll a seam which is positioned adjacent a wall.

Applicant's inventive structure having the rollers spaced outwardly of the handle portions, insures that rolling of planar flooring adjacent to a wall surface can be performed. At the same time, the handle will not scuff or mar any of the wall surfaces while this rolling is being performed.

These and other features of tile present invention can be best understood from the following specifications and drawings, of which the following is a brief description.

DESCRIPTION OF THE PREFERRED EMBODIMENT

Figure 1:
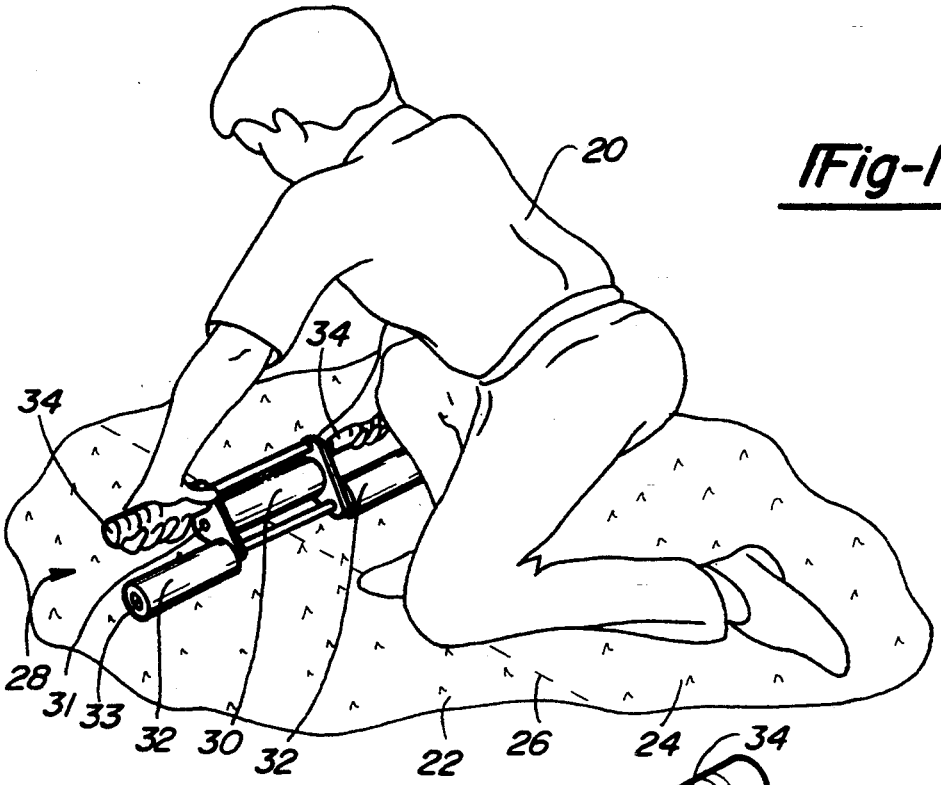
FIG. 1 is a perspective view of the use of the inventive roller.

FIG. 1 shows a user 20 installing a first planar floor section 22 adjacent to a second planar floor section 24. A seam 26 is defined between the ends of the sections 22 and 24. As shown, a roller assembly 28 includes a first roller section defined by a pair of axially outer roller 32 rotating about an axis 33 and a second central roller 30 rotating on an axis 31, spaced from axis 33. As also shown, a pair of handles 34 are positioned above the outer rollers 32, and are aligned on an axis which is offset from both axes 31 and 33.

As shown, when user 20 applies a force through handles 34, that force is transferred to floor sections 22 and 24 through roller 30 and rollers 32. Preferably, the axis of handle 34 is evenly spaced between axes 31 and 33, such that the force is evenly divided between roller 30 and the pair of rollers 32. Since the force on roller 30 is approximately equal to the force on both rollers 32, the force on roller 30 will be twice as great as the force in either of the rollers 32. It is preferably the force on roller 30 which is used to smooth the seam 26 when two sections 22 and 24 are being placed together.

As mentioned above, the use of the spaced roller sections insures that the roller assembly 28 will not pivot due to the application of force by user 20. User 20 applies a downward force, and a force tending to roll the roller assembly 28 along the planar flooring sections 22 and 24. The spaced roller sections prevent any pivoting of the roller assembly 28 due to this force.

When it be necessary to smooth an edge seam of a planar floor section then a outer roller section 32 rolls along the end seam. The handle sections 34 do not extend axially outwardly to the full extent of the sections 32, and thus the sections 34 do not provide any obstruction to the use of the outer rollers 32 rolling such an outer seam.

Figure 2:
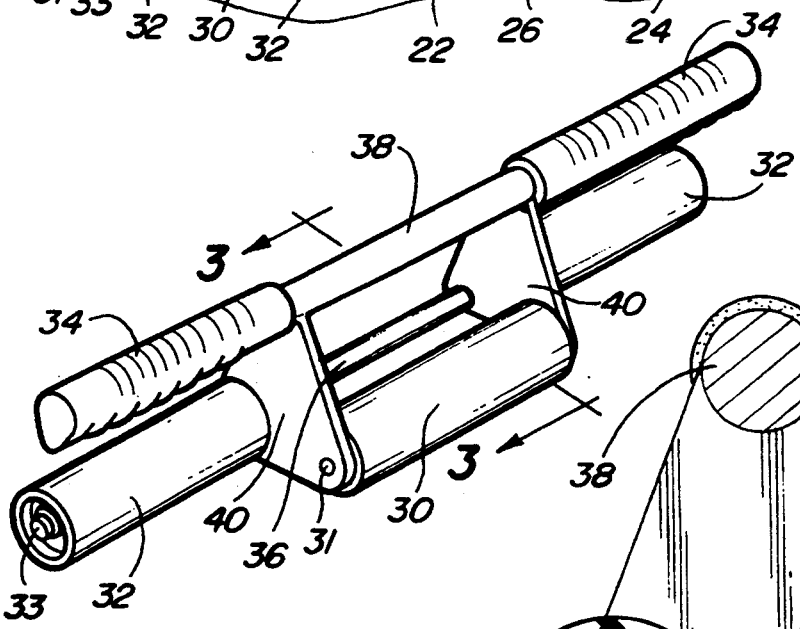
FIG. 2 is a perspective view of the inventive roller.

As shown in FIG. 2, a bar 36 extends between rollers 32. A handle portion 38 also extends between the handle portions 34. Triangular mount brackets 40 mount rollers 32 and roller 30. Roller 30 is mounted between the adjacent brackets 40, while the roller sections 32 are mounted outwardly of the bracket sections 40.

Figure 3:
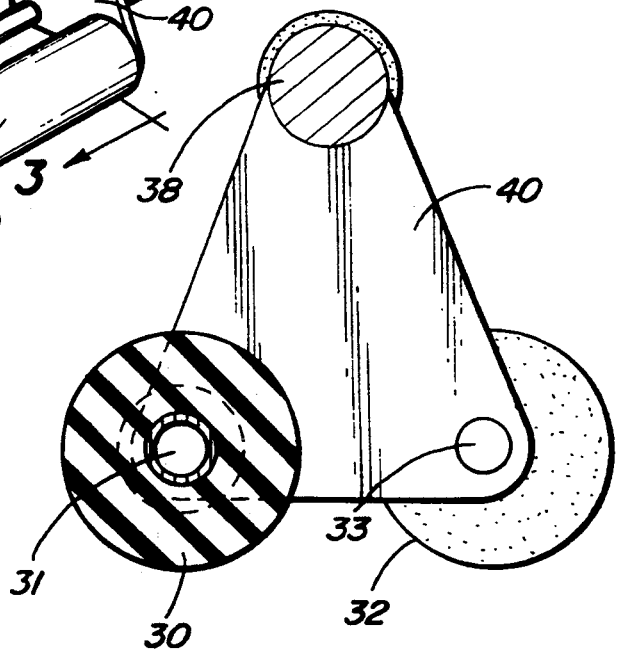
FIG. 3 is a cross-sectional view along line 3—3 as shown in FIG. 2.

As shown in FIG. 3, a central axis of the handle, at the center of handle portion 38, is equal distance between axes 31 and 33. Further, the length and diameter of the two rollers 32 and the central roller 30 are equal such that the surface area of the combined rollers 32 is double the surface area of roller 30.

Although a preferred embodiment of this invention has been disclosed, a worker of ordinary skill in the art would recognize that certain modifications would come within the scope of this invention. For that reason, the following claims should be studied in order to determine the true scope and content of this invention.

I claim:

1. A roller assembly for use on planar flooring comprising:

a pair of spaced roller sections;

a first of said roller sections rotating on a first axis;

a second of said roller sections rotating on a second axis laterally spaced from said first axis;

a handle extending along an axis which is non-coaxial to both said first and second axes; and said second roller section including a single central roller, and said first roller section including a pair of outer rollers spaced axially outwardly from the location of said central roller.

2. A roller assembly as recited in claim 1, wherein said handle axis is equally spaced from both said first and second axis.

3. A roller assembly as recited in claim 1, wherein the axial length of said central roller, and each of said two outer rollers are equal.

4. A roller assembly as recited in claim 1, wherein said first and second roller sections are mounted to a pair of spaced brackets, with said central roller being mounted between said brackets, and said outer rollers of said first roller section being mounted outwardly of respective ones of said brackets.

5. A roller assembly as recited in claim 4, wherein said handle includes handle portions extending outwardly of said brackets.

6. A roller assembly as recited in claim 5, wherein said outer rollers extend axially outwardly away from said brackets for a greater distance than said handle portions.

7. A roller assembly as recited in claim 1, wherein the axial length of said central roller, and each of said two outer rollers are equal.

8. A roller assembly as recited in claim 7, wherein said first and second roller sections are mounted to a pair spaced brackets, with said central roller being mounted between said brackets, and said outer rollers of said first roller section being mounted outwardly of respective ones of said brackets.

9. A roller assembly as recited in claim 8, wherein said handle includes handle portions extending outwardly of said brackets.

10. A roller assembly as recited in claim 9, wherein said outer rollers extend axially outwardly away from said brackets for a greater distance than said handle portions.

11. A roller assembly for use on planar floorings comprising;

a handle extending along a handle axis;

at least one roller rotating about a roller axis;

means to secure said handle to said at least one roller such that said handle axis being offset from said roller axis, and said roller extending for a greater distance than said handle in at least one direction along said roller axis;

there being first and second roller sections, each of said roller sections rolling about its own axis, and each of said roller section axes being offset from said handle axis; and said second roller section includes a single central roller, and said first roller section includes a pair of outer rollers spaced axially outwardly from the location of said central roller.

12. A roller assembly as recited in claim 11, wherein said handle axis is equally spaced from both said first and second axes.

13. A roller assembly as recited in claim 11, wherein the axial length of said central roller, and each of said two outer rollers are equal.

14. A roller assembly as recited in claim 11, wherein said first and second roller sections are mounted to a pair of spaced brackets, with said central roller being mounted between said brackets, and said outer rollers of said first roller portion being mounted outwardly of respective ones of said brackets.

15. A roller assembly as recited in claim 14, wherein said handle includes handle portions extending outwardly of said brackets.

16. A roller assembly as recited in claim 15, wherein said outer rollers extend axially outwardly away from said brackets for a greater distance than said handle portions.

* * * * *